US006453779B2

(12) United States Patent
Hu

(10) Patent No.: US 6,453,779 B2
(45) Date of Patent: Sep. 24, 2002

(54) POSITIONING DEVICE FOR A SWITCH MEMBER OF A REVERSIBLE RATCHET-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/814,430

(22) Filed: Mar. 21, 2001

(30) Foreign Application Priority Data

Jul. 21, 2000 (TW) ..... 89212815 U

(51) Int. Cl.[7] ..... B25B 13/46

(52) U.S. Cl. ..... 81/63; 81/63; 81/63.2

(58) Field of Search ..... 81/63, 63.2, 63.1, 81/62, 60, 58.4

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | | 5/1934 | Kress | |
| 2,317,461 A | | 4/1943 | Jackson | |
| 2,542,241 A | | 2/1951 | Fors | |
| 2,657,604 A | | 11/1953 | Rueb | |
| 2,701,977 A | | 2/1955 | Stone | |
| 2,764,048 A | | 9/1956 | Thompson | |
| 2,769,360 A | | 11/1956 | Cottrell et al. | |
| 2,800,821 A | | 7/1957 | Fruscella | |
| 2,891,434 A | | 6/1959 | Lozensky | |
| 2,957,377 A | * | 10/1960 | Hare | 81/63 |
| 3,019,682 A | | 2/1962 | Hare | |
| 3,250,157 A | | 5/1966 | Badger | |
| 3,265,171 A | * | 8/1966 | Kilness | 81/63 |
| 3,337,014 A | | 8/1967 | Sandrick | |
| 3,393,587 A | | 7/1968 | Jolliff et al. | |
| 3,393,780 A | | 7/1968 | Kilness | |
| 3,436,992 A | * | 4/1969 | Over et al. | 81/63.1 |
| 3,577,816 A | | 5/1971 | Alexander et al. | |
| 3,713,356 A | | 1/1973 | Knudsen | |

(List continued on next page.)

FOREIGN PATENT DOCUMENTS

| | | | | |
|---|---|---|---|---|
| FR | 498276 | * | 1/1920 | 81/60 |

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A reversible ratchet-type wrench includes a handle and a head extended from the handle. A web defined between the handle and the head includes a cavity communicated with a hole of the head and a receiving hole communicated with the cavity. An inner periphery defining the receiving hole includes a first positioning notch and a second positioning notch. A pawl is mounted in the cavity and includes a first side with teeth for meshing with teeth of a drive member rotatably mounted in the hole of the head. A switch member includes a turn-piece outside the receiving hole of the web for manual operation. The switch member further includes a positioning section extending from the turn-piece and a switching section extending from the positioning section. The positioning section is rotatably received in the receiving hole of the web and has a positioning member retained in one of the first positioning notch and the second positioning notch of the receiving hole of the web. A biasing/actuating member has a first end attached to the positioning section of the switch member and a second end attached to a second side of the pawl for biasing the teeth of the first side of the pawl to engage with the teeth of the drive member.

22 Claims, 13 Drawing Sheets

U.S. PATENT DOCUMENTS 3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A * 9/1983 Gummow ..... 81/60
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A * 4/1993 Arnold et al. ..... 81/177.8
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A * 10/2000 Chaconas ..... 81/63
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

POSITIONING DEVICE FOR A SWITCH MEMBER OF A REVERSIBLE RATCHET-TYPE WRENCH

BACKGROUND OF THE INVENTION

1. Field of the Invention

The present invention relates to a positioning device for a switch member of a reversible ratchet-type wrench.

2. Description of the Related Art

U.S. Pat. No. 2,957,377 issued to Hare on Oct. 25, 1960 discloses a reversible ratchet type wrench comprising a body 10 having a handle 11 and a head 12. A cap 39 and an annular wall 44 are provided to upper side and lower side of the head 12, respectively. Yet, this increases the assembly time and the manufacture cost and adversely affects the appearance. A shifting lever 35 is retained in place by a spring 33 that is located in a cylindrical opening 34. Nevertheless, formation of the cylindrical opening 34 that extends at an incline upward is relatively difficult. In addition, formation of the cavity 16 having converging straight sides 17, 18 which diverge in the direction of the periphery of rotatable member 14 requires expensive and accurate computer-numeric-control (CNC), which further results in an increase in the cost together with a low production rate. This is why such a reversible ratchet type wrench is hardly seen in the market.

FIGS. 9 and 10 illustrate another conventional ratchet type wrench comprising a handle 12' and a head 11'. The head 11' is machined to form four consecutive compartments for receiving the drive member 20', the pawl 30' and the shifting lever 40', wherein three of the compartments can be formed by cutting, yet the remaining one must be machined by CNC. Further, the resultant head structure is relatively weak and thus has a poor torque-bearing capacity. In addition, the movement of the pawl 30' for changing ratcheting direction is found unreliable, as it is achieved via transmission of the hook end 442' of a spring 44' attached to the shifting lever 40'.

SUMMARY OF THE INVENTION

It is the primary object of the present invention to provide a positioning device for a switch member of a reversible ratchet-type wrench. The resultant ratchet-type wrench is easy to manufacture and assemble.

It is another object of the present invention to provide a reversible ratchet-type wrench that can be manufactured within a relatively short period of time at low cost without using computer-controlled lathes.

A reversible ratchet-type wrench in accordance with the present invention comprises:

a handle;

a head extended from the handle and having a hole, a web being defined between the handle and the head, the web including a cavity communicated with the hole of the head and a receiving hole communicated with the cavity, an inner periphery defining the receiving hole including a first positioning notch and a second positioning notch;

a drive member rotatably mounted in the hole of the head and including a plurality of teeth defined in an outer periphery thereof;

a pawl mounted in the cavity and including a first side facing the hole of the head and a second side facing away from the hole of the head, the first side of the pawl including a plurality of teeth for meshing with the teeth of the drive member;

a switch member including a turn-piece outside the receiving hole of the web for manual operation, the switch member further including a positioning section extending from the turn-piece and a switching section extending from the positioning section, the positioning section being rotatably received in the receiving hole of the web and having a positioning member retained in one of the first positioning notch and the second positioning notch of the receiving hole of the web, the turn-piece being movable to move the positioning member into one of the first positioning notch and the second positioning notch; and a biasing/actuating means having a first end attached to the positioning section of the switch member and a second end attached to the second side of the pawl for biasing the teeth of the first side of the pawl to engage with the teeth of the drive member;

wherein when the positioning member is retained in the first positioning notch of the receiving hole of the web, the wrench allows ratcheting in a first direction, and when the positioning member is retained in the second positioning notch of the receiving hole of the web, the wrench allows ratcheting in a second direction that is reverse to the first direction.

The receiving hole is a cylindrical hole extending along a direction that is perpendicular to a longitudinal axis of the handle. The second side of the pawl includes a recess. An inner wall defining the recess includes an arcuate groove for receiving the second end of the biasing/actuating means. The biasing/actuating means includes an actuating member and an elastic member. The actuating member has a wider middle portion, a first end, and a second end. The elastic member includes a first end attached to the first end of the actuating member and a second end attached to the switching section of the switch member. The second end of the actuating member is biased by the elastic member into the arcuate groove of the pawl. The second end of the actuating member is round. The switching section of the switch member includes a receptacle for receiving the second end of the elastic member. Two reinforcing pieces project outward from an area that surrounds an end of the receptacle, and the middle portion of the actuating member are guided between the reinforcing pieces.

The positioning section of the switch member includes two opposite flat sides to allow slight sliding movement of the switch member in the receiving hole of the web. Each of the two positioning notches includes an inclined section adjacent to the other positioning notch to guide the positioning member out of one of the positioning notches and into the other positioning notch.

An inner periphery defining the hole of the head includes an annular groove. The outer periphery of the drive member includes an annular groove. A C-clip is received in the annular groove of the head and the annular groove of the drive member, thereby rotatably mounting the drive member in the head. The drive member may be a gear wheel.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
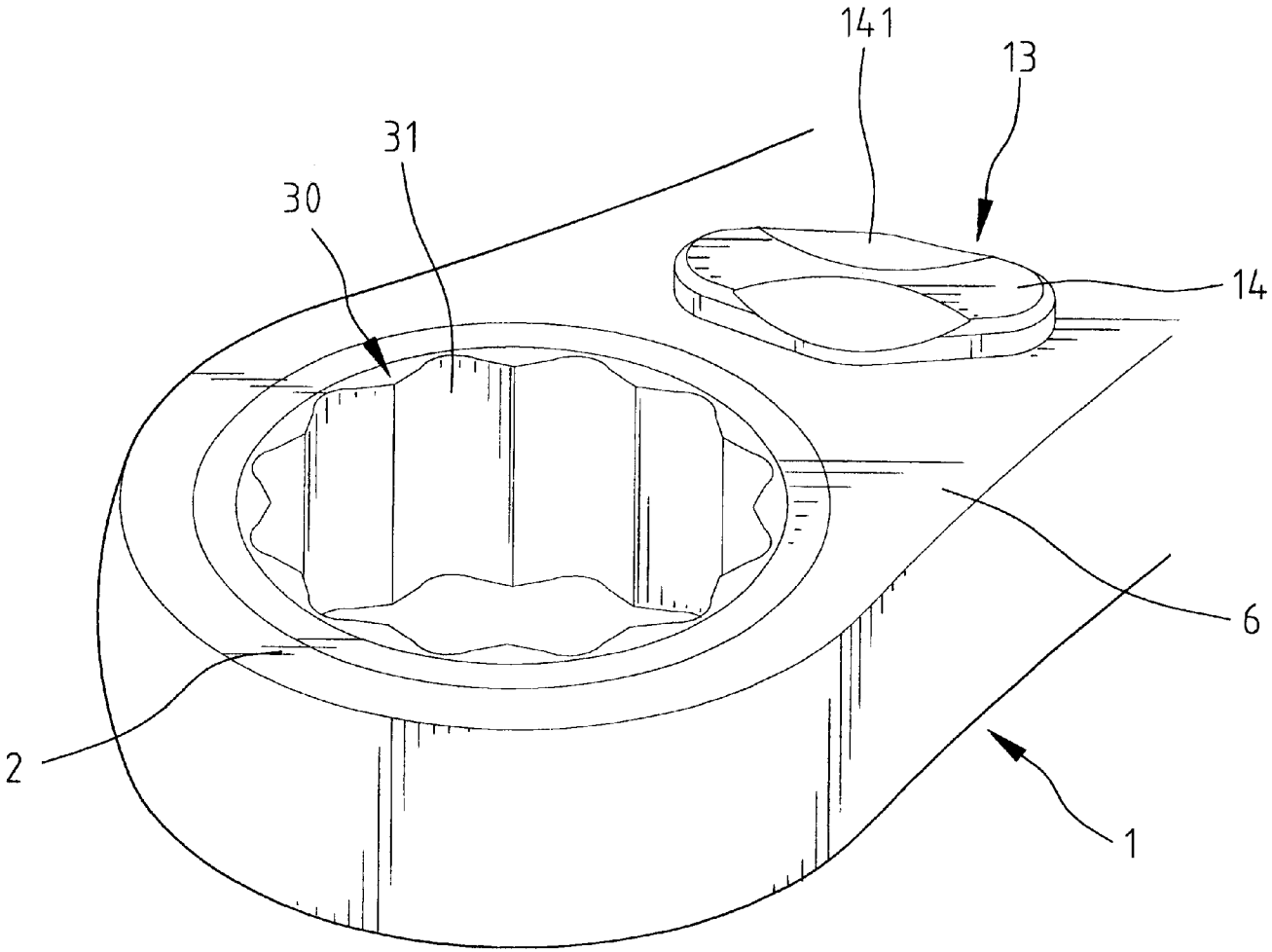
FIG. 1 is a perspective view of an end portion of a ratchet-type wrench in accordance with the present invention.

Referring to FIGS. 1 through 8 and initially to FIGS. 1, 2, 3, and 5, a ratchet-type wrench 1 in accordance with the present invention generally includes a handle 3 and a head 2 extended from the handle 3 and having a hole 2*a.* An inner periphery 4 defining the hole 2*a* of the head 2 includes an annular groove 5 in a lower portion thereof. A web 6 is defined between the head 2 and the handle 3. A cavity 7 is defined in the web 6. Also defined in the web 6 is a receiving hole 8 that is communicated with the cavity 7. The receiving hole 8 is substantially cylindrical and extends along an axis that is perpendicular to a longitudinal direction of the handle 3. Two positioning notches 9 are defined in an inner periphery defining the receiving hole 8, which will be described in detail later.

A drive member (in the form of a gear wheel 30 in this embodiment) is mounted in the head 2 and includes an inner periphery 31 for driving a fastener (not shown) and an outer periphery 32. The outer periphery 32 of the gear wheel 30 includes an upper end portion 33, a lower end portion 34, and a middle portion with a plurality of recessed teeth 35. The lower end portion 34 includes an annular groove 36. A C-clip 37 is received in the annular groove 36 of the lower end portion 34 and the annular groove 5 of the head 2, thereby rotatably retaining the gear wheel 30 in the head 2 of the wrench 1, best shown in FIG. 3.

Figure 7:
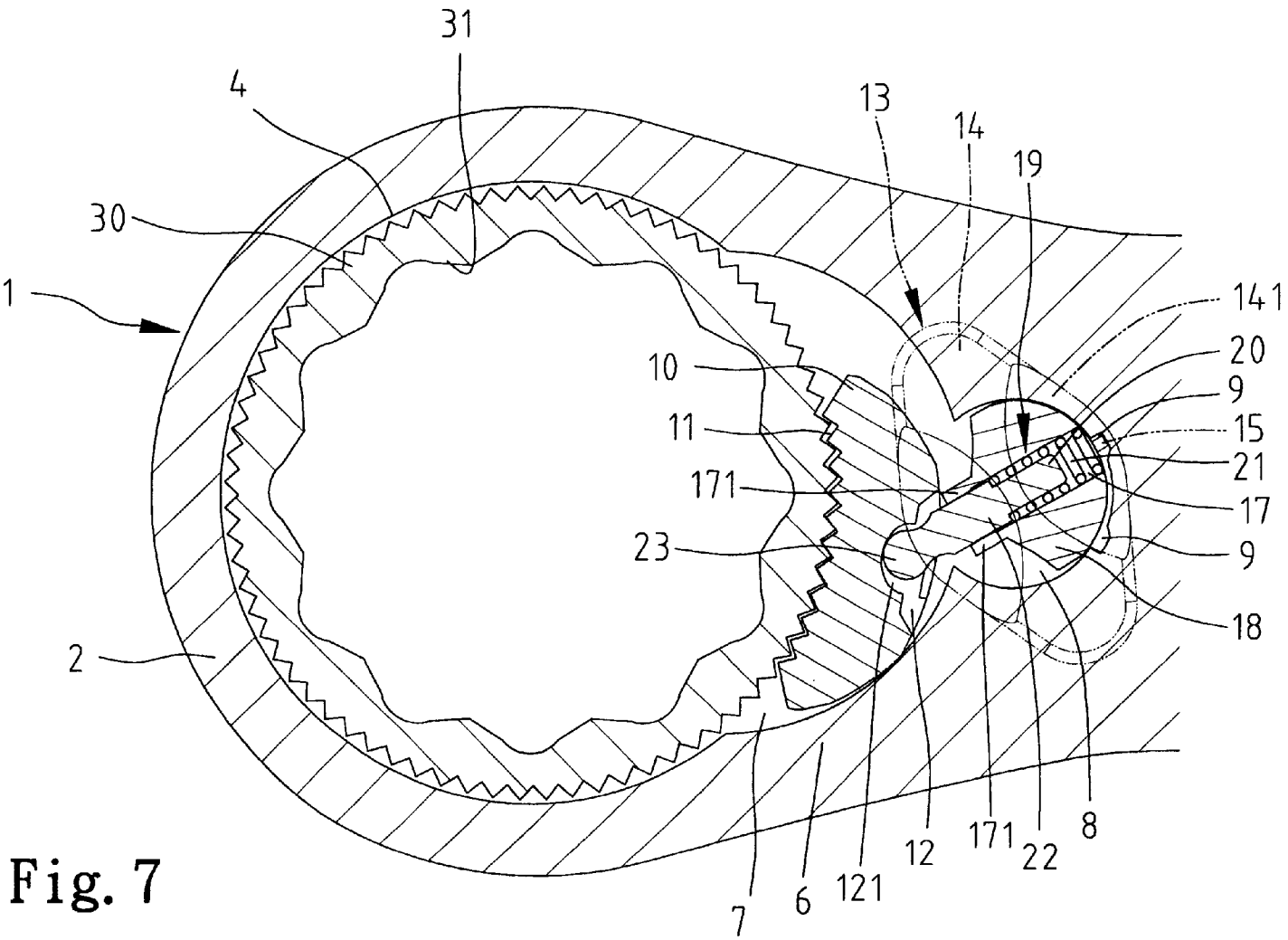
FIG. 7 is a sectional view taken along line 7—7 in FIG. 3.

A pawl 10 is mounted in the cavity 7 in the web 6 and includes ratchet teeth 11 on a side thereof for engaging with teeth 35 of the gear wheel 30. The other side of the pawl 10 further includes a recess 12. As illustrated in FIG. 7, an inner wall defining the recess 12 includes an arcuate groove 121 defined therein, which will be described later.

Figure 2:
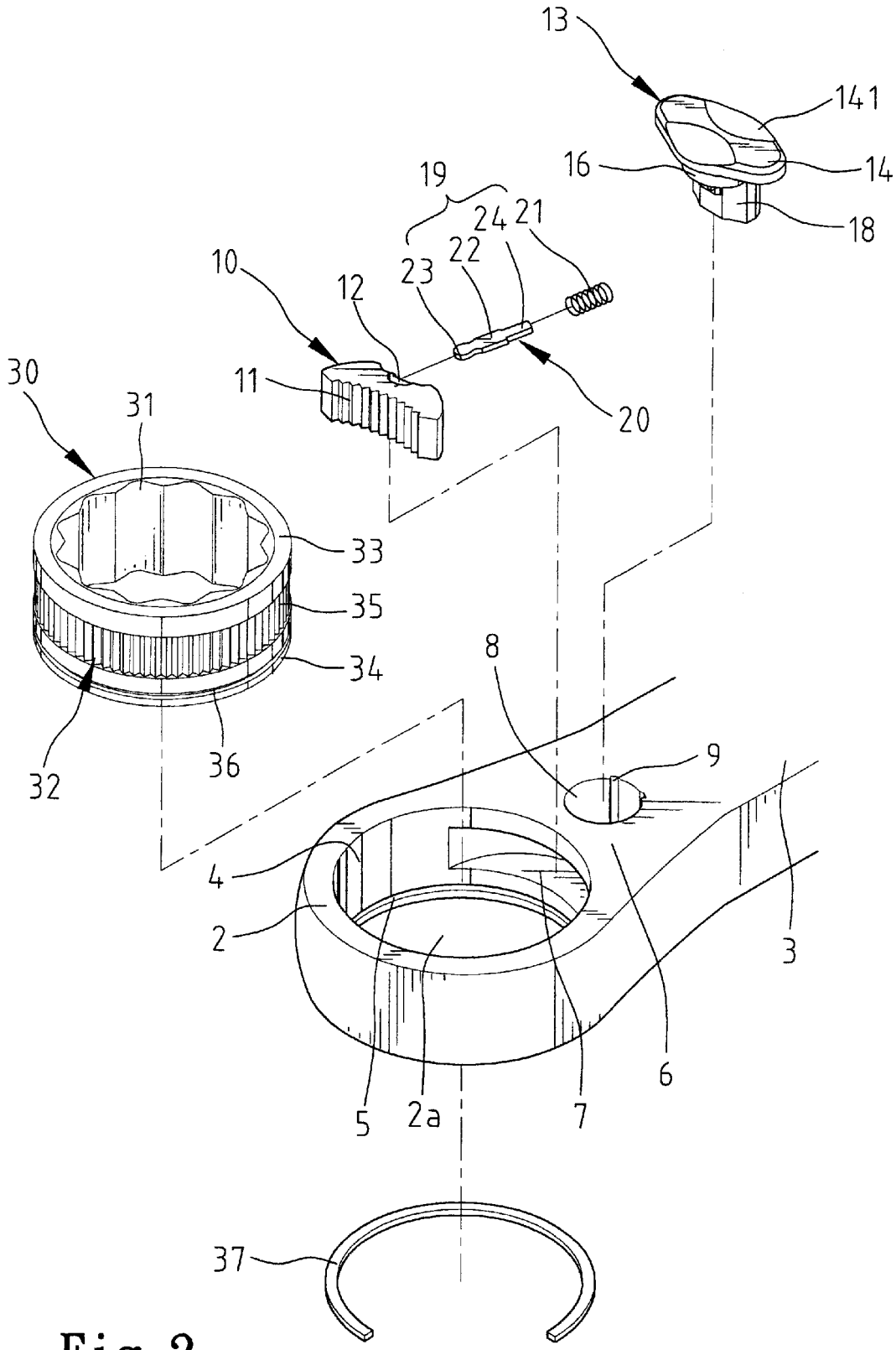
FIG. 2 is an exploded perspective view of the end portion of the ratchet-type wrench in accordance with the present invention.
Figure 3:
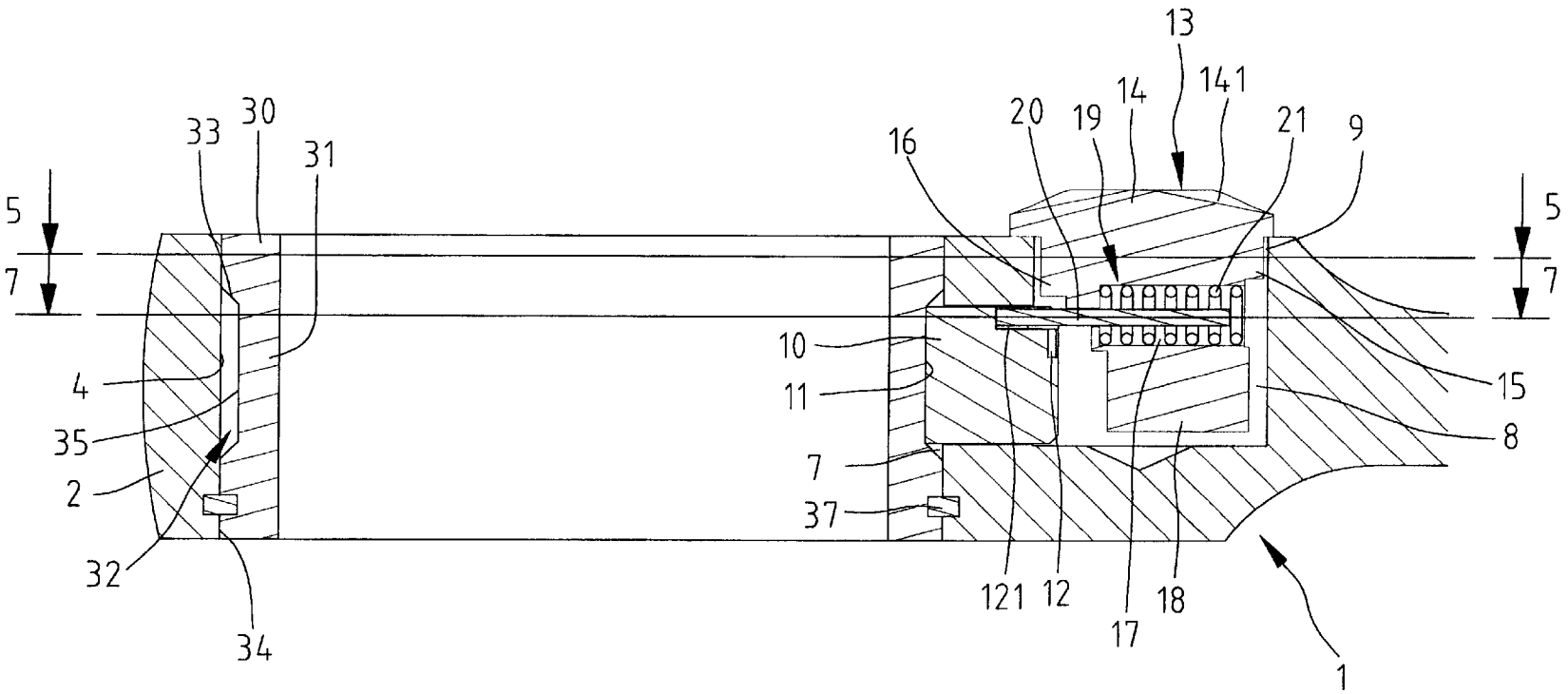
FIG. 3 is a longitudinal sectional view of the end portion of the ratchet-type wrench in accordance with the present invention.
Figure 4:
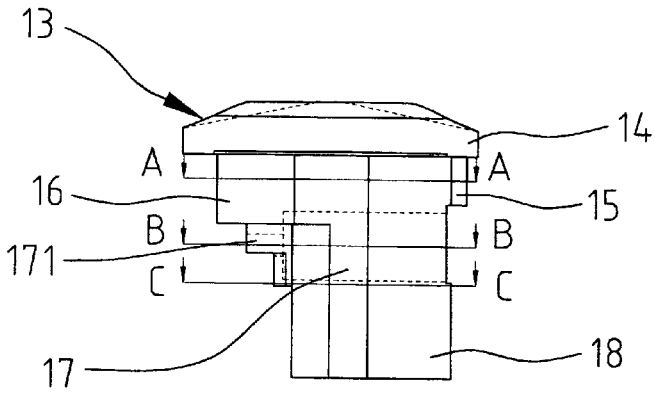
FIG. 4 is a side view of a switch member in accordance with the present invention.
Figure 4A:
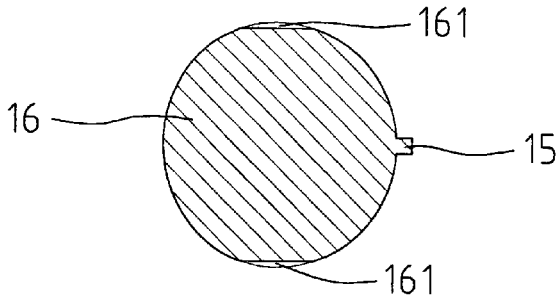
FIG. 4*a* is a sectional view taken along line A—A in FIG. 4.
Figure 4B:
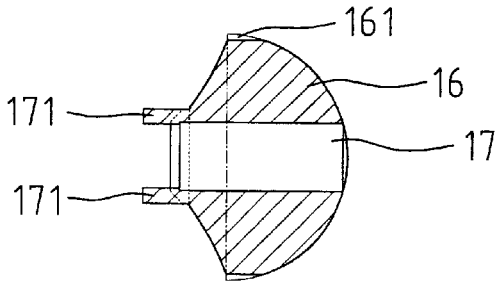
FIG. 4*b* is a sectional view taken along line B—B in FIG. 4.
Figure 4C:
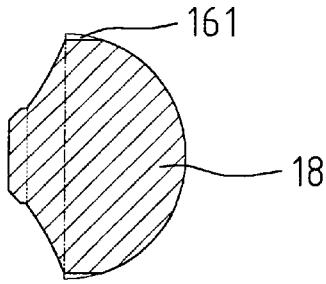
FIG. 4*c* is a sectional view taken along line C—C in FIG. 4.

Still referring to FIGS. 1 through 3 and further to FIGS. 4*a* through 4*c,* a switch member 13 is rotatably mounted in the receiving hole 8. In this embodiment, the switch member 13 includes a substantially rhomboid turn-piece 14 outside the receiving hole 8 for manual operation and a positioning section 16 extending from the turn-piece 14 and having a positioning member 15. Two recessed portions 141 are defined in a top face of the turn-piece 14 to allow easy operation for the user's fingers. The positioning member 15, as illustrated in FIG. 4*a,* is a protrusion projecting from the positioning section 16. The positioning section 16 is trimmed at two opposite sides thereof to form two flat faces 161 that are substantially parallel to each other. Thus, in addition to rotational movement, the positioning section 16 is slidable in the receiving hole 8 by a relatively small distance, which will be described in detail later. As illustrated in FIG. 4*b, a* switching section 18 is provided below the positioning section 16 and includes a receptacle 17 and a pair of reinforcing pieces 171 projecting outward from an area that surrounds an end of the receptacle 17. The switching section 18 is shorter than the positioning section 16 and includes a stepped structure, as shown in FIGS. 3 and 4.

A biasing/actuating means 19 includes an actuating member 20 and an elastic member 21. The actuating member 20 has a wider middle portion 22 against which an end of the elastic member 21 abuts. An end 24 of the actuating member 20 around which a portion of the elastic member 21 is mounted is received in the receptacle 17 of the switching section 18 of the switch member 13 with the middle portion 22 of the actuating member 20 being covered by the reinforcing pieces 171. Namely, the reinforcing pieces 171 restrain movement of the end 24 of the actuating member 20 even if the end 24 is exposed outside the receptacle 17. The other end 23 of the actuating member 20 is round and is engaged in the arcuate groove 121 of the recess 12 of the pawl 10. Thus, the pawl 10 is moved via transmission by the actuating member 20 when the switch member 13 is turned, thereby changing the ratcheting direction of the wrench.

Figure 5:
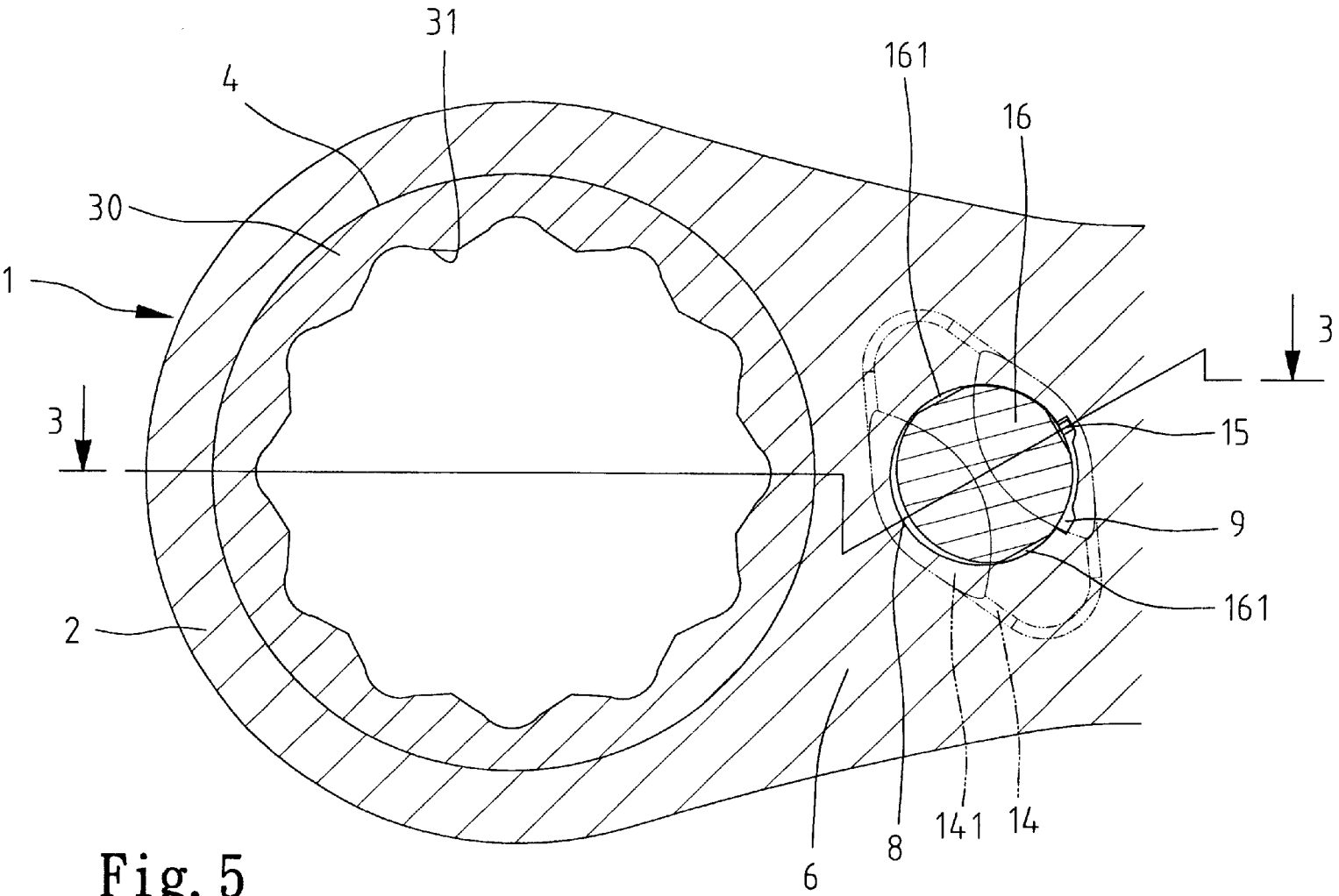
FIG. 5 is a sectional view taken along line 5—5 in FIG. 3.
Figure 5A:
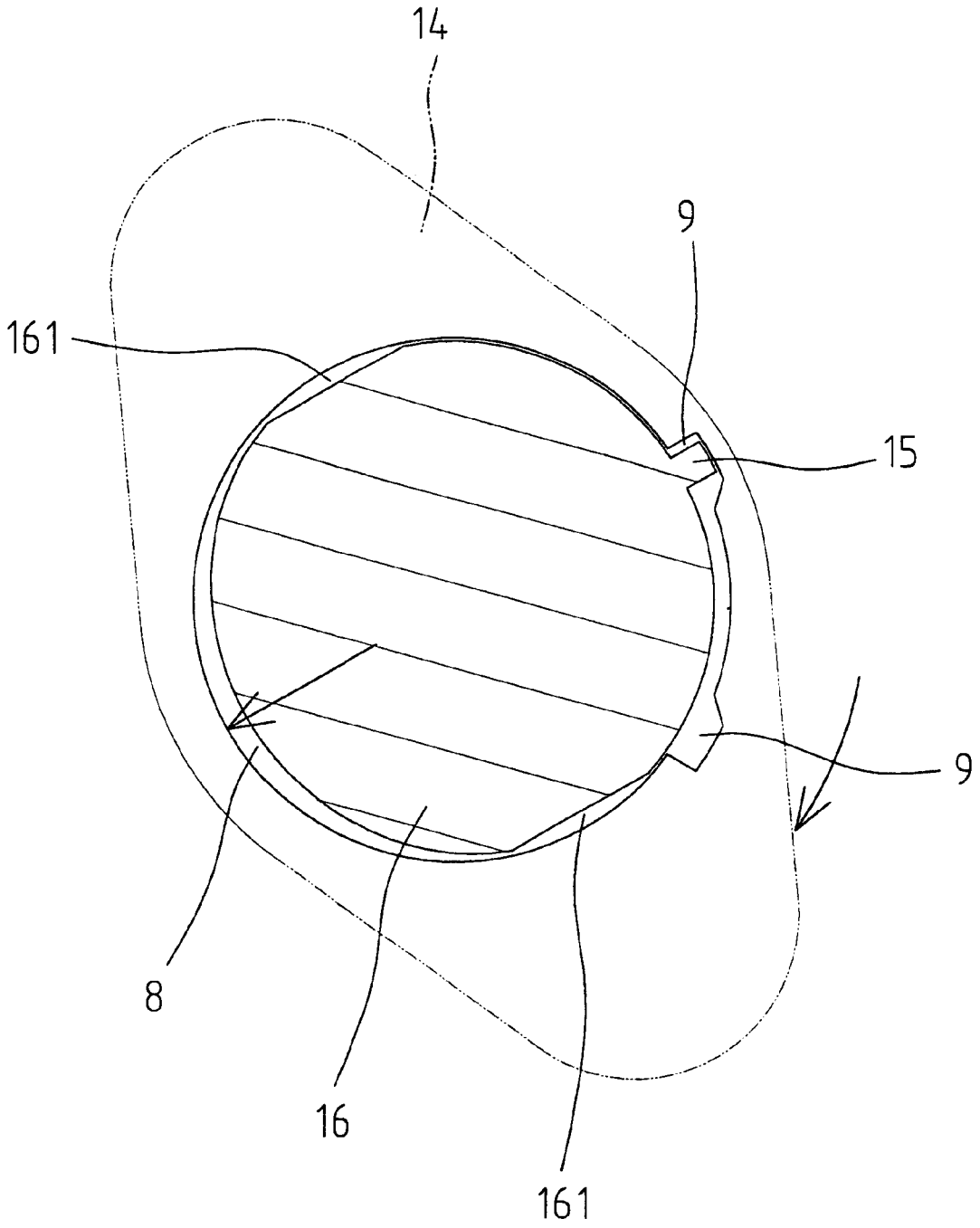
FIG. 5*a* is an enlarged sectional view of the switch member in FIG. 5.

The ratchet-type wrench shown in FIGS. 3, 5, and 7 is in a status allowing clockwise ratcheting (free rotation in counterclockwise direction), in which the positioning member 15 is received in one of the notches 9 (the upper one in FIG. 5) and the round end 24 of the actuating member 20 is received in the arcuate groove 121 of the recess 12 of the pawl 10. Thus, a side face (not labeled) of the pawl 10 bears against the lower wall surface of the cavity 7.

Figure 5B:
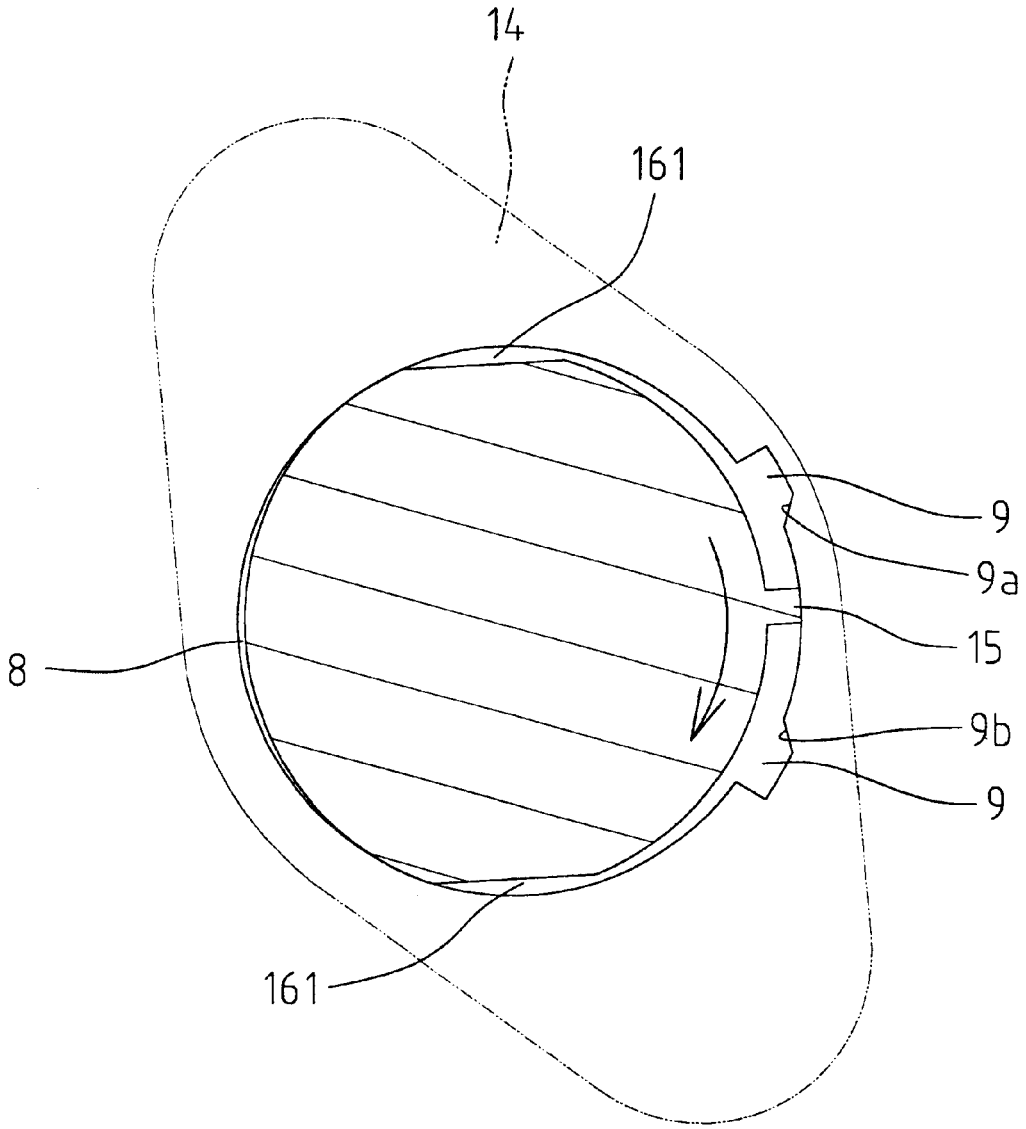
FIG. 5*b* is a sectional view similar to FIG. 5*a,* illustrating switching of the switch member.
Figure 5C:
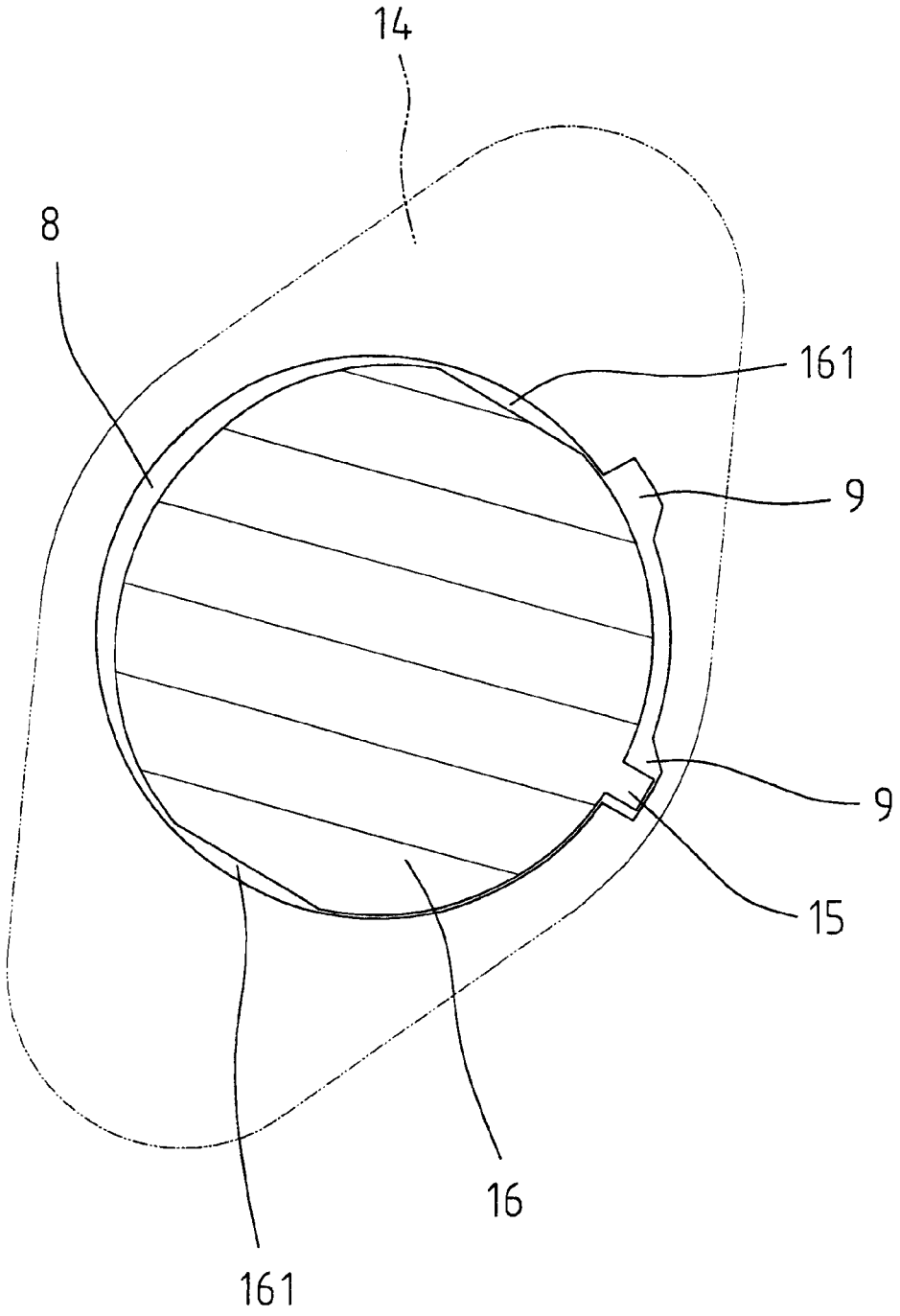
FIG. 5*c* is a sectional view similar to FIG. 5*a,* wherein the switch member is retained in another position.
Figure 6:
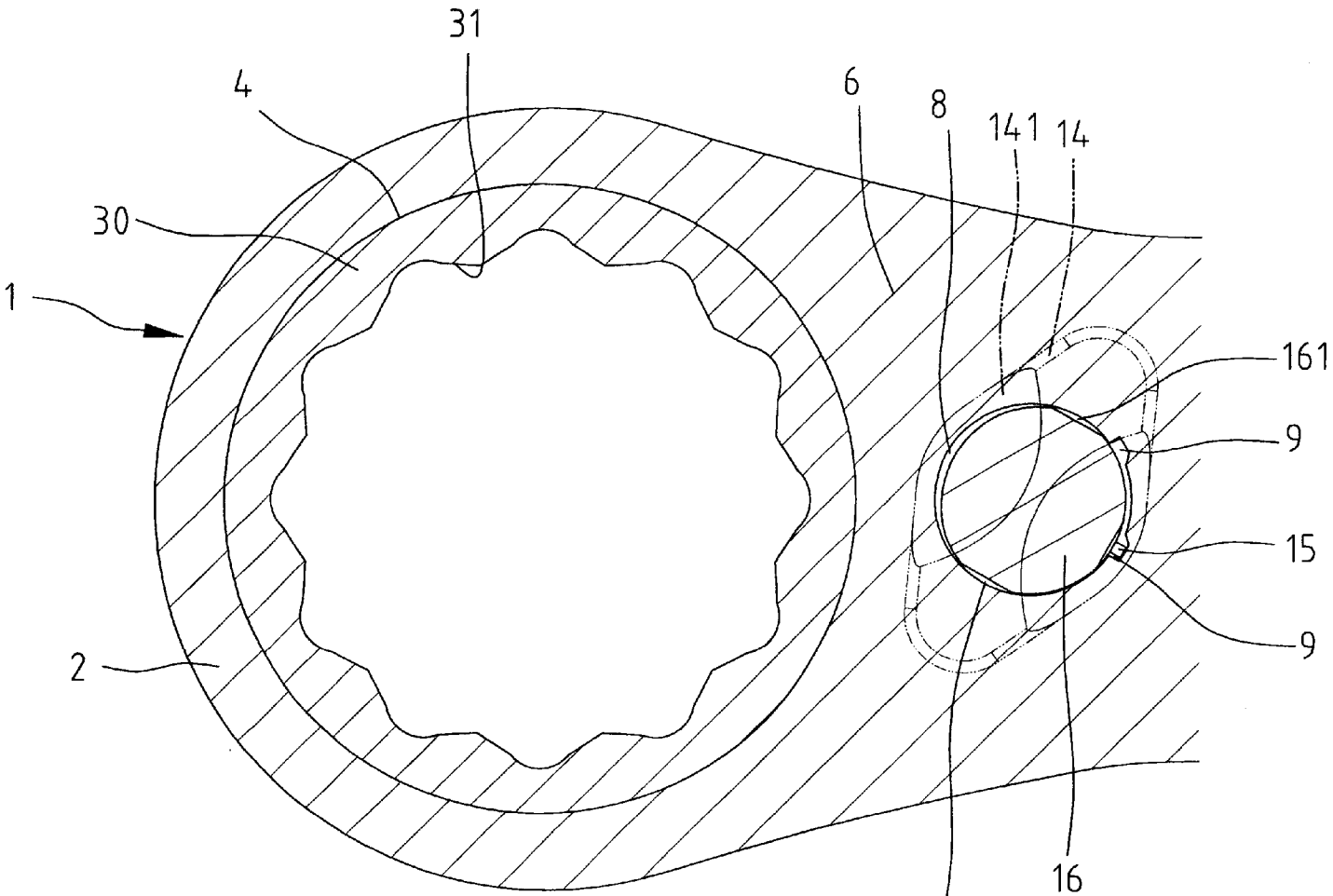
FIG. 6 is a sectional view similar to FIG. 5, wherein the switch member is retained in another position.
Figure 8:
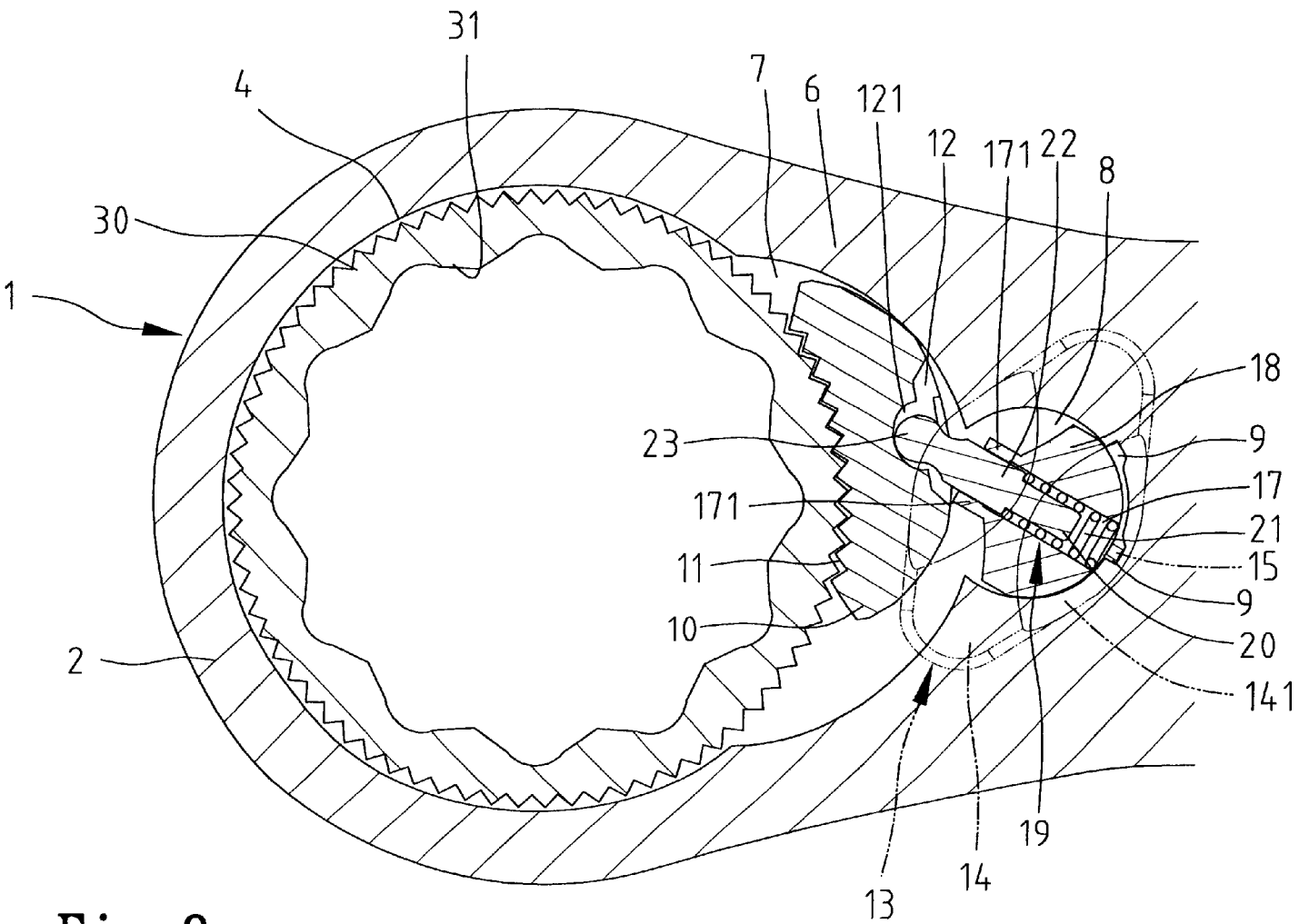
FIG. 8 is a sectional view similar to FIG. 7, wherein the switch member is retained in another position.
Figure 9:
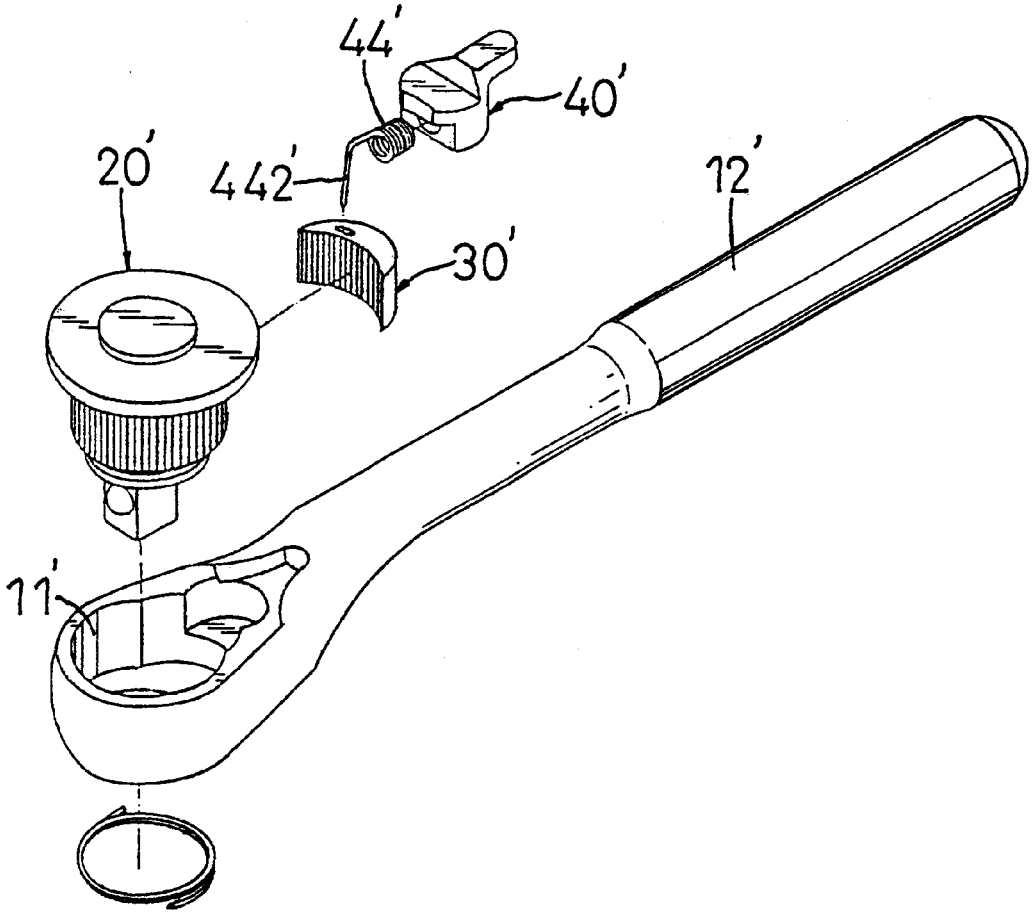
Fig. 9 PRIOR ART
FIG. 9 is an exploded perspective view of a conventional ratchet type wrench.
Figure 10:
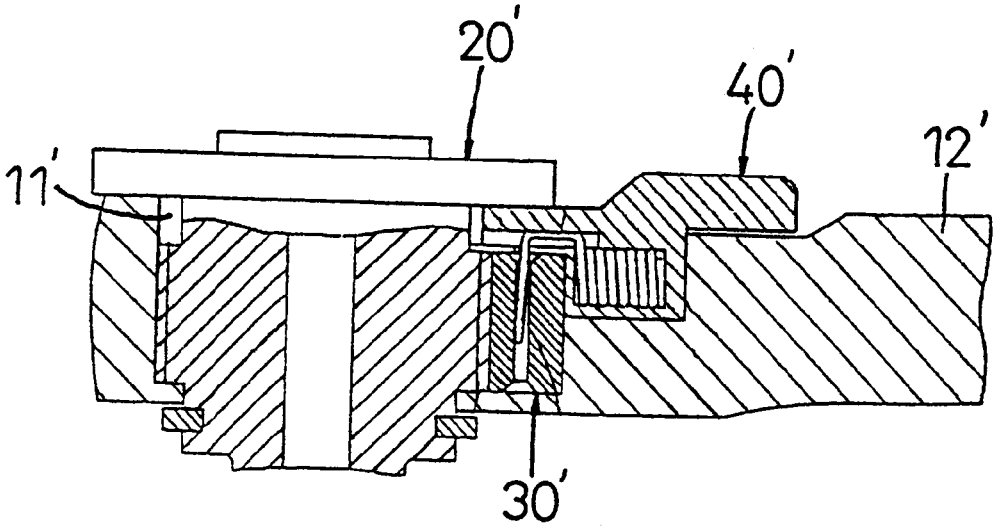
Fig. 10 PRIOR ART
FIG. 10 is a sectional view of a head of the conventional ratchet type wrench in FIG. 9.

When the turn-piece 14 is turned clockwise for changing the ratcheting direction, the elastic member 21 is compressed and the positioning member 15 is moved out of the notch 9 and moved toward the other notch 9 as illustrated in FIG. 5*b.* The flat faces 161 of the positioning section 16 of the switch member 13 allow slight sliding of the positioning section 16 in the receiving hole 8. When the positioning member 15 reaches the other notch 9 (FIG. 5*c*), the elastic member 21 returns to its initial state to retain the positioning member 15 of the positioning section 16 in place. In addition, as illustrated in FIG. 8, the round end 23 of the actuating member 20 of the biasing/actuating means 19 is extended into the arcuate groove 121 of the recess 12 of the pawl 10, and the pawl 10 is moved to an upper side of the cavity with another side face (not labeled) of the pawl 10 bearing against the upper wall surface of the cavity 7. Change in the ratcheting direction of the wrench is thus completed. It is noted that each positioning notch 9 includes an inclined section 9*a,* 9*b* (FIG. 5*b*) adjacent to the other positioning notch 9 to guide the positioning member 15 out of one of the positioning notches 9 and then into the other positioning notch 9.

Although the invention has been explained in relation to its preferred embodiment, it is to be understood that many other possible modifications and variations can be made without departing from the scope of the invention as hereinafter claimed.

What is claimed is:

1. A reversible ratchet-type wrench comprising:

a handle;

a head extended from the handle and having a hole, a web being defined between the handle and the head, the web including a cavity communicated with the hole of the head and a receiving hole communicated with the cavity, an inner periphery defining the receiving hole including a first positioning notch and a second positioning notch;

a drive member rotatably mounted in the hole of the head and including a plurality of teeth defined in an outer periphery thereof;

a pawl mounted in the cavity and including a first side facing the hole of the head and a second side facing away from the hole of the head, the first side of the pawl including a plurality of teeth for meshing with the teeth of the drive member;

a switch member including a turn-piece outside the receiving hole of the web for manual operation, the switch member further including a positioning section extending from the turn-piece and a switching section extending from the positioning section, the positioning section being rotatably and radially slideably received in the receiving hole of the web and having a positioning member retained in one of the first positioning notch and the second positioning notch of the receiving hole of the web, the turn-piece being movable to move the positioning member into one of the first positioning notch and the second positioning notch; and a biasing/actuating means having a first end attached to the switching section of the switch member and a second end attached to the second side of the pawl for biasing the teeth of the first side of the pawl to engage with the teeth of the drive member;

wherein when the positioning member is retained in the first positioning notch of the receiving hole of the web, the wrench allows ratcheting in a first direction, and when the positioning member is retained in the second positioning notch of the receiving hole of the web, the wrench allows ratcheting in a second direction that is reverse to the first direction.

2. The reversible ratchet-type wrench as claimed in claim 1, wherein the receiving hole is a cylindrical hole extending along a direction that is perpendicular to a longitudinal axis of the handle.

3. The reversible ratchet-type wrench as claimed in claim 1, wherein the second side of the pawl includes a recess, an inner wall defining the recess including an arcuate groove for receiving the second end of the biasing/actuating means.

4. The reversible ratchet-type wrench as claimed in claim 3, wherein the biasing/actuating means includes an actuating member and an elastic member, the actuating member having a wider middle portion, a first end, and a second end, the elastic member including a first end attached to the first end of the actuating member and a second end attached to the switching section of the switch member, the second end of the actuating member being biased by the elastic member into the arcuate groove of the pawl.

5. The reversible ratchet-type wrench as claimed in claim 4, wherein the second end of the actuating member is round.

6. The reversible ratchet-type wrench as claimed in claim 4, wherein the switching section of the switch member includes a receptacle for receiving the second end of the elastic member.

7. The reversible ratchet-type wrench as claimed in claim 6, further comprising two reinforcing pieces projecting outward from an area that surrounds an end of the receptacle, the middle portion of the actuating member being guided between the reinforcing pieces.

8. The reversible ratchet-type wrench as claimed in claim 1, wherein the positioning section of the switch member includes two opposite flat sides to allow slight radial sliding movement of the switch member in the receiving hole of the web, with the positioning member and the first end of the biasing/actuating means pawl located intermediate the two opposite flat sides.

9. The reversible ratchet-type wrench as claimed in claim 2, wherein the positioning section of the switch member includes two opposite flat sides to allow slight radial sliding movement of the switch member in the receiving hole of the web, with the positioning member and the first end of the biasing/actuating means located intermediate the two opposite flat sides.

10. The reversible ratchet-type wrench as claimed in claim 3, wherein the positioning section of the switch member includes two opposite flat sides to allow slight radial sliding movement of the switch member in the receiving hole of the web, with the positioning member and the first end of the biasing/actuating means located intermediate the two opposite flat sides.

11. The reversible ratchet-type wrench as claimed in claim 4, wherein the positioning section of the switch member includes two opposite flat sides to allow slight radial sliding movement of the switch member in the receiving hole of the web, with the positioning member and the first end of the biasing/actuating means located intermadiate the two opposite flat sides.

12. The reversible ratchet-type wrench as claimed in claim 5, wherein the positioning section of the switch member includes two opposite flat sides to allow slight radial sliding movement of the switch member in the receiving hole of the web, with the positioning member and the first end of the biasing/actuating means located intermediate the two opposite flat sides.

13. The reversible ratchet-type wrench as claimed in claim 6, wherein the positioning section of the switch member includes two opposite flat sides to allow slight radial sliding movement of the switch member in the receiving hole of the web, with the positioning member and the first end of the biasing/actuating means located intermediate the two opposite flat sides.

14. The reversible ratchet-type wrench as claimed in claim 7, wherein the positioning section of the switch member includes two opposite flat sides to allow slight radial sliding movement of the switch member in the receiving hole of the web, with the positioning member and the first end of the biasing/actuating means located intermediate the two opposite flat sides.

15. The reversible ratchet-type wrench as claimed in claim 1, wherein each of the two positioning notches includes an inclined section adjacent to the other positioning notch to guide the positioning member out of one of the positioning notches and then into the other positioning notch.

16. The reversible ratchet-type wrench as claimed in claim 1, wherein an inner periphery defining the hole of the head includes an annular groove, the outer periphery of the drive member including an annular groove, further comprising a C-clip received in the annular groove of the head and the annular groove of the drive member, thereby rotatably mounting the drive member in the head.

17. The reversible ratchet-type wrench as claimed in claim 16, wherein the drive member is a gear wheel.

18. The reversible ratchet-type wrench as claimed in claim 1, wherein the drive member is a gear wheel.

19. The reversible ratchet-type wrench as claimed in claim 1, with the positioning section and the positioning member being integrally formed as a single component and without the use of any other securement.

20. A reversible ratchet-type wrench comprising, in combination:

a rotatably mounted drive member including a plurality of teeth defined in an outer periphery thereof;

a pawl including a first side having a plurality of teeth adapted to mesh with the teeth of the drive member and including a second side facing away from the first side; and a switch member rotatably and radially slideably received in a receiving hole, with the receiving hole including a first positioning notch and a second positioning notch circumferentially spaced from the first positioning notch, with the switch member having a positioning member to be retained in one of the first positioning notch and the second positioning notch, with the pawl being operatively connected to the switch member with the pawl being biased away from the switch member and towards the drive member to engage the teeth of the pawl with the teeth of the drive member;

wherein when the positioning member is retained in the first positioning notch of the receiving hole, the wrench allows ratcheting in a first direction, and when the positioning member is retained in the second positioning notch of the receiving hole, the wrench allows ratcheting in a second direction that is reverse to the first direction.

21. The reversible ratchet-type wrench as claimed in claim 20, further comprising, in combination: an actuating member; and an elastic member, with the actuating member and the elastic member being mounted to and movable with the switch member, with the actuating member abutting with the second side of the pawl, with the pawl being operatively connected to the switch member by the actuating member and the elastic member, with the elastic member biasing the actuating member relative to the switch member for biasing the pawl away from the switch member.

22. The reversible ratchet-type wrench as claimed in claim 20, with the switch member including two opposite, parallel, flat sides to allow slight radially slideable movement of the switch member in the receiving hole.

* * * * *